US010215529B2

(12) United States Patent
Cabahug et al.

(10) Patent No.: US 10,215,529 B2
(45) **Date of Patent: *Feb. 26, 2019**

(54) ACCESSORY MOUNT FOR RIFLE ACCESSORY RAIL, COMMUNICATION, AND POWER TRANSFER SYSTEM—ACCESSORY ATTACHMENT

(75) Inventors: Eric Cabahug, Fairfax, VA (US); Ben Feldman, Reston, VA (US); John Schroeder, Leesburg, VA (US); James Dodd, Linden, VA (US); Hector Tapia, Ashburn, VA (US)

(73) Assignee: Prototype Productions Incorporated Ventures Two, LLC, Ashburn, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/689,436

(22) Filed: Jan. 19, 2010

(65) Prior Publication Data

US 2010/0218410 A1 Sep. 2, 2010

Related U.S. Application Data

(60) Provisional application No. 61/145,216, filed on Jan. 16, 2009.

(51) Int. Cl.
*F41C 27/00* (2006.01)
*F41C 23/16* (2006.01)
*F41G 11/00* (2006.01)

(52) U.S. Cl.
CPC ..... *F41C 27/00* (2013.01); *F41C 23/16* (2013.01); *F41G 11/003* (2013.01)

(58) Field of Classification Search
CPC ..... F41C 27/00; F41C 23/16; F41G 11/003
USPC ..... 42/85
See application file for complete search history.

(56) References Cited

U.S. PATENT DOCUMENTS 4,533,980 A 8/1985 Hayes
4,595,809 A * 6/1986 Pool ..... H01H 13/48 200/284
4,777,861 A * 10/1988 Lecuyer et al. ..... 89/1.813
4,883,932 A * 11/1989 Van Hout ..... H01H 23/14 200/337
4,931,605 A * 6/1990 Zoller ..... H01H 13/06 200/406
5,033,219 A * 7/1991 Johnson et al. ..... 42/115
5,142,806 A 9/1992 Swan
(Continued)

OTHER PUBLICATIONS

U.S. Appl. No. 12/689,430 Non-Final Office Action dated Feb. 17, 2011, 4 pages.

(Continued)

*Primary Examiner* — Michelle Clement
(74) *Attorney, Agent, or Firm* — Merchant & Gould P.C.

(57) ABSTRACT

The present invention is related to weapons systems. In particular, the present invention is directed to accessory attachment systems for rifles and small arms weapons that enable attached accessory devices to draw power from a central power source and communicate with the user and/or other devices. The present invention embodies firearm systems comprising at least one mounting rail comprising at least one power connection, at least one power source, at least one rail accessory comprising a rail grabber or mount, wherein the at least one rail accessory receives electrical power from the power source.

20 Claims, 6 Drawing Sheets

(56) References Cited

U.S. PATENT DOCUMENTS 5,360,949 A 11/1994 Duxbury
5,669,174 A * 9/1997 Teetzel ..... F41A 9/62 356/5.01
5,822,905 A 10/1998 Teetzel
5,826,363 A 10/1998 Olson
6,163,131 A * 12/2000 Gartstein et al. ..... 320/118
6,237,271 B1 5/2001 Kaminski
6,618,976 B1 * 9/2003 Swan ..... 42/114
6,622,416 B2 * 9/2003 Kim ..... 42/146
6,925,744 B2 8/2005 Kincel
6,931,775 B2 8/2005 Burnett
6,965,085 B1 * 11/2005 Orrico ..... H01H 11/0006 200/314
7,144,830 B2 12/2006 Hill et al.
7,243,454 B1 7/2007 Cahill
RE40,216 E * 4/2008 Swan ..... 42/71.01
7,421,818 B2 9/2008 Houde-Walter
7,464,495 B2 12/2008 Cahill
7,525,203 B1 4/2009 Racho
7,548,697 B2 6/2009 Hudson et al.
7,559,169 B2 * 7/2009 Hung et al. ..... 42/119
7,562,483 B2 7/2009 Hines
7,584,569 B2 9/2009 Kallio et al.
7,627,975 B1 * 12/2009 Hines ..... F41G 11/003 42/84
7,640,690 B2 1/2010 Hines
7,676,975 B2 * 3/2010 Phillips et al. ..... 42/72
7,712,241 B2 5/2010 Teetzel et al.
7,818,910 B2 * 10/2010 Young ..... 42/71.01
7,827,726 B2 * 11/2010 Stokes ..... 42/146
7,841,120 B2 11/2010 Teetzel et al.
7,866,083 B2 1/2011 Teetzel
7,954,971 B1 * 6/2011 Kincaid ..... F41C 33/0254 362/110
7,975,419 B2 7/2011 Darian
8,001,715 B2 8/2011 Stokes
8,042,967 B2 * 10/2011 Hikmet ..... F21V 5/00 362/200
8,091,265 B1 1/2012 Teetzel et al.
8,151,505 B2 * 4/2012 Thompson ..... 42/84
8,453,369 B1 * 6/2013 Kincaid ..... F41C 33/0254 403/322.1
2005/0241206 A1 11/2005 Teetzel et al.
2008/0010890 A1 1/2008 Vice et al.
2008/0025028 A1 * 1/2008 Gloisten ..... F21V 5/04 362/294
2008/0039962 A1 2/2008 McRae
2008/0040965 A1 2/2008 Solinsky et al.
2008/0063400 A1 3/2008 Hudson et al.
2008/0134562 A1 * 6/2008 Teetzel ..... 42/146
2008/0170838 A1 7/2008 Teetzel et al.
2008/0190002 A1 * 8/2008 Hines ..... F41C 27/00 42/1.06
2009/0044439 A1 * 2/2009 Phillips et al. ..... 42/72
2009/0108589 A1 4/2009 Racho
2009/0255160 A1 10/2009 Summers
2010/0031552 A1 2/2010 Houde-Walter
2010/0083553 A1 4/2010 Montgomery
2010/0192443 A1 8/2010 Cabahug et al.
2010/0192444 A1 8/2010 Cabahug et al.
2010/0192446 A1 8/2010 Darian
2010/0192448 A1 8/2010 Darian
2010/0218410 A1 9/2010 Cabahug et al.
2010/0242332 A1 * 9/2010 Teetzel ..... F41A 23/08 42/72
2011/0000120 A1 1/2011 Thompson
2011/0010979 A1 * 1/2011 Houde-Walter ..... F41C 23/22 42/84
2011/0126622 A1 6/2011 Turner
2011/0162251 A1 * 7/2011 Houde-Walter ..... F41G 1/35 42/146
2011/0173865 A1 7/2011 Compton et al.
2013/0061504 A1 * 3/2013 Malherbe ..... F41G 11/003 42/84
2015/0020427 A1 * 1/2015 Compton ..... F41C 27/00 42/71.01

OTHER PUBLICATIONS

Third Party Submission by Michael B. Brooks dated May 12, 2011.
U.S. Appl. No. 13/845,379 Final Office Action dated Aug. 5, 2014, 9 pages.

* cited by examiner

Open Position Retractable Contacts

Closed Position Retractable Contacts

ACCESSORY MOUNT FOR RIFLE ACCESSORY RAIL, COMMUNICATION, AND POWER TRANSFER SYSTEM—ACCESSORY ATTACHMENT

BACKGROUND OF THE INVENTION

The present invention is related to weapons systems. In particular, the present invention is directed to accessory attachment systems for rifles and small arms weapons that enable attached accessory devices to draw power from a central power source and communicate with the user and/or other devices.

The current rifles and small arm weaponry in use by US armed forces can be equipped with numerous combat optics, laser designators/sights, and flashlights; all comes with different power requirements and battery supplies. The result is a heavy weapon and a heavier field load of batteries to accommodate the various accessories, which ultimately impacts the soldiers' effectiveness, particularly on longer missions. One of the US Army focus areas is improving the performance of their soldiers' combat equipment while reducing the load that each soldier has to carry. One of these efforts is concentrated on providing advanced technologies to demonstrate the feasibility of an innovative communications rail and power transfer system. The resulting system will be backwards compatible with current mission support devices and accessories that mount to small arms weapons during operational procedures and it will reduce the overall weight penalties of the current system.

SUMMARY OF THE INVENTION

It is an object of the present invention to obviate or mitigate at least one disadvantage of previous firearm accessory rails.

In a first embodiment of the present invention, there is provided a firearm accessory mounting rail for attachment of a firearm accessory to the barrel of a firearm. The accessory rail may provide a connection for the firearm accessory.

The present invention embodies firearm systems comprising at least one mounting rail comprising at least one power connection, at least one power source, at least one rail accessory comprising a rail grabber or mount, wherein the at least one rail accessory receives electrical power from the power source.

Another embodiment of the present invention provides an accessory attachment system for rifles and small arms weapons that enables attached accessory devices to draw power from a central power source and communicate with the user or other devices without exposed wires.

Other aspects and features of the present invention will become apparent to those ordinarily skilled in the art upon review of the following description of specific embodiments of the invention in conjunction with the accompanying figures.

DETAILED DESCRIPTION OF THE INVENTION

For simplicity and illustrative purposes, the principles of the present invention are described by referring to various exemplary embodiments thereof. Although the preferred embodiments of the invention are particularly disclosed herein, one of ordinary skill in the art will readily recognize that the same principles are equally applicable to, and can be implicated in other compositions and methods, and that any such variation would be within such modifications that do not part from the scope of the present invention. Before explaining the disclosed embodiments of the present invention in detail, it is to be understood that the invention is not limited in its application to the details of any particular embodiment shown, since of course the invention is capable of other embodiments. The terminology used herein is for the purpose of description and not of limitation. Further, although certain methods are described with reference to certain steps that are presented herein in certain order, in many instances, these steps may be performed in any order as may be appreciated by one skilled in the art, and the methods are not limited to the particular arrangement of steps disclosed herein.

A variety of accessories can be mounted to different locations on a weapon. The U.S. Army supplied PPI with a list of typical accessories that are presently used or could be used on the weapon, however the invention is applicable to ANY powered accessory which attaches to the weapon via an accessory rail system. (See Table 1)

TABLE 1

| M4 Accessories | |
|---|---|
| Accessory | National Stock Number |
| No Power Required | |
| Advanced Combat Optical Gunsight | NSN 1240-01-412-6608 |
| Low Power Required | |
| M68 Close Combat Optics | NSN 1240-01-411-1265 |
| M145 Machine Gun Optics | NSN 1240-01-411-6350 |
| AN/PEQ-2A Target Illuminator | NSN 5885-01-447-8992 |
| AN/PVS-4 Night Vision Sight | NSN 5855-00-629-5334 |
| AN/PVS-14, Monocular Night Vision Device | NSN 5855-01-432-0524 |
| AN/PAQ-4C, Infrared Aiming Light | NSN 5855-01-398-4315 |
| High Power Required | |
| AN/PAS-13B(V)1, Light Weight Thermal System | NSN 5855-01-383-6558 |

A primary goal is to reduce the quantity and variety of batteries that power accessories mounted to a weapon. Having a variety of batteries increases the weight that needs to be carried during a mission and increases the complexity of the supply chain.

PPI proposed several solutions for the power and communications from the Picatinny Rail to the accessories. All four were based on a Rail Grabber/Accessory Mount that would clamp to the standard MIL-STD-1913 profile and transfer power and communication signals. One of the designs utilized inductive coupling, and three of the designs used galvanic contacts.

Figure 1:
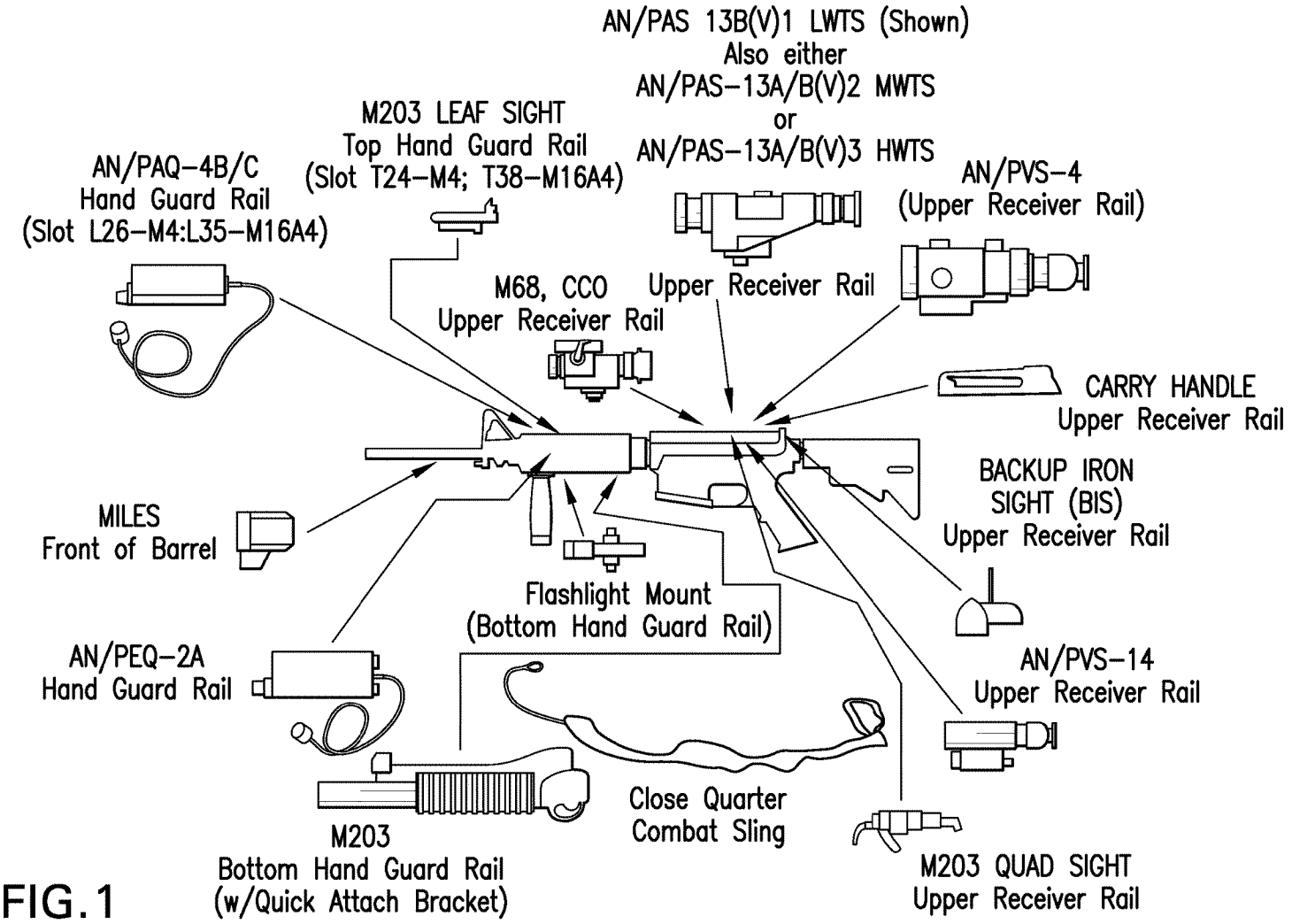
FIG. 1 shows typical accessories that are presently used or could be used on a weapon.
Figure 2:
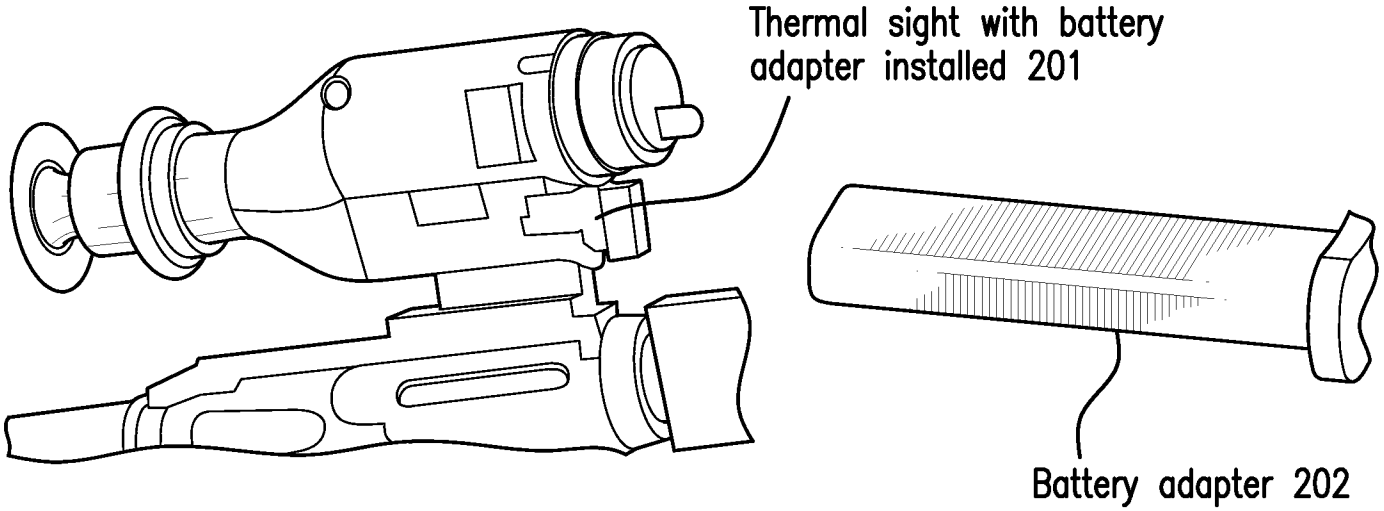
FIG. 2 shows a thermal scope with battery adapter.

Internal battery adapters will be created for the accessories that mount to the rifle. This approach replaces the existing batteries with a DC-DC converter packaged as a drop-in replacement into the existing battery compartment. PPI is initially testing on the Thermal Night Vision Scope and a tactical flashlight. FIG. 2 shows a thermal scope [201] with battery adapter [202] installed, and the battery adapter [202] respectively.

Figure 3:
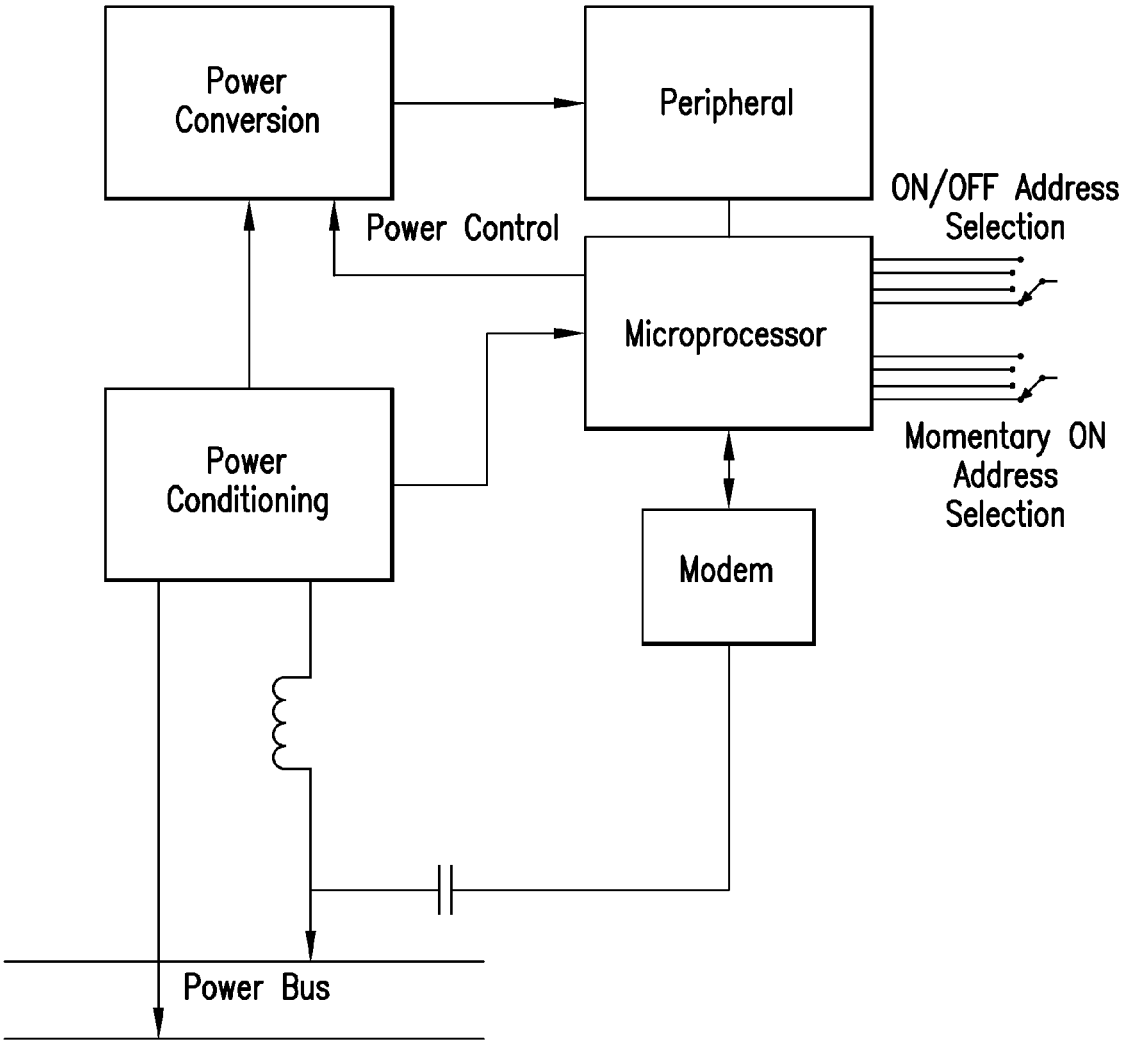
FIG. 3 shows a schematic block diagram of a battery adapter.

The battery adapter [202] contains a DC/DC converter circuit and control electronics, as well as selector switches for identification. The current strategy for addressing components will employ a pair of selector switches on each battery adapter [202]. One switch will assign a user control button ID that corresponds to momentary power for the accessory, and a second switch will assign a user control button identity that corresponds to on/off action. As an example, if the user wanted to momentarily power a target illuminator, they would hold down button 1, which would power the accessory as long as the button was depressed. If they wanted to maintain power to the illuminator, they would press and release button 2. To turn off the accessory, they would press the button again. Alternatively, one button per accessory could be assigned, in either momentary or on/off configuration. This approach maximizes flexibility and allows the accessories to be field selected depending on mission. A schematic block diagram is shown in FIG. 3.

The galvanic contact styles can share a common design for a rail grabber, which includes retract/insert mechanism that extends the contact when the grabber is mounted and closed around the Picatinny rail. Another style of rail grabber like the tactical flashlight can have an integrated rail grabber with stationary contacts extending through to make contact with the bus bars.

Figure 4:
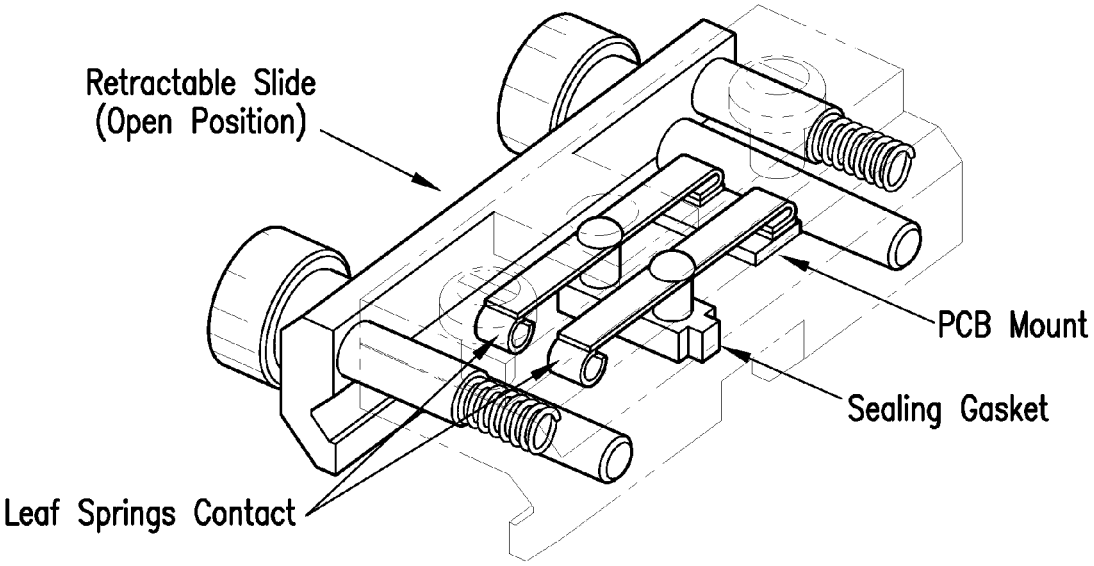
FIG. 4 shows two rail grabbers in accordance with the present invention.
Figure 4:
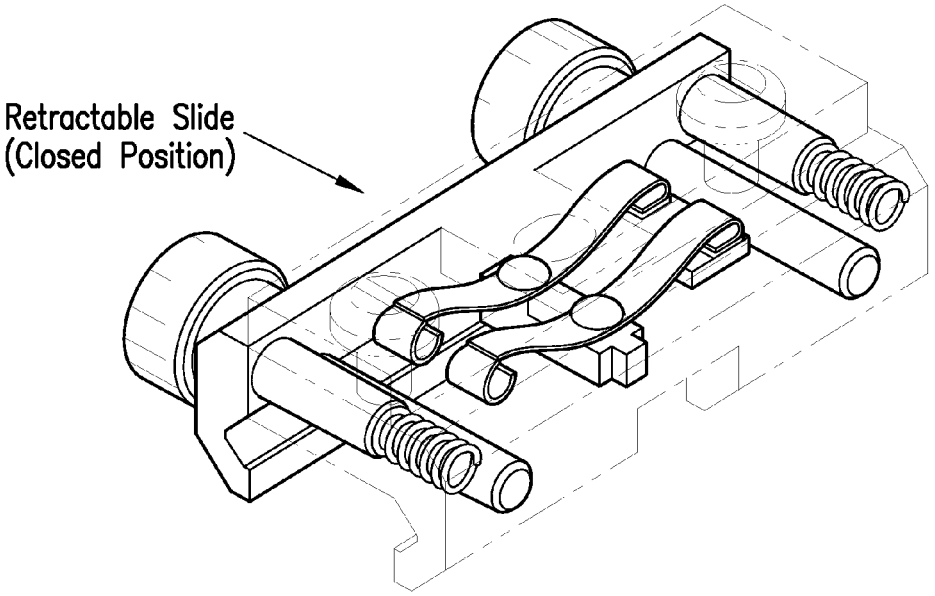
Figure 5:
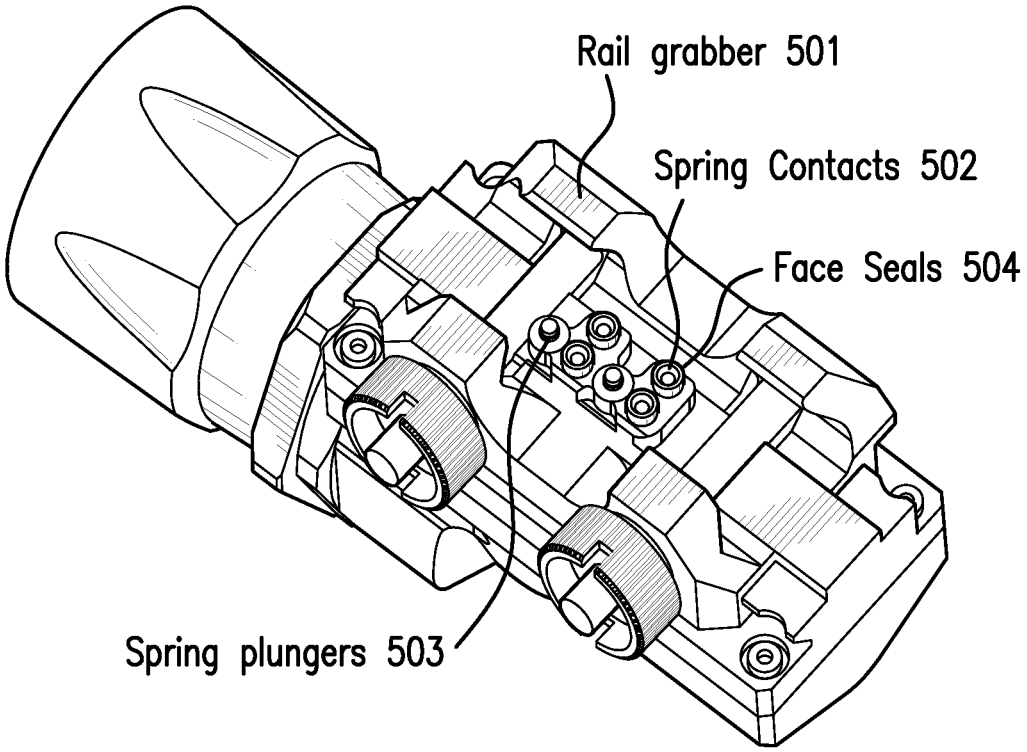
FIG. 5 shows a powered rail accessory mounting assembly, a typical embodiment of the invention.

FIG. 4 below shows two embodiments of the rail grabbers that can be used in conjunction with the powered Picatinny rails, one with stationary contacts and the other with retractable contacts. A typical embodiment of the invention includes the use of a powered rail accessory mounting assembly as shown in FIG. 5. The mounting assembly attaches the typical accessory to the powered accessory rail and consists of: the rail grabber [501], the spring contacts [502], the spring plungers [503] and the face seals [504]. The spring plungers [503] depress the snap-dome switches on the powered rail, the spring contacts [502] provide electrical contact with the fixed electrical bus contacts on the powered rail PCB assembly, and the face seals [504] provide environmental protection.

Figure 6:
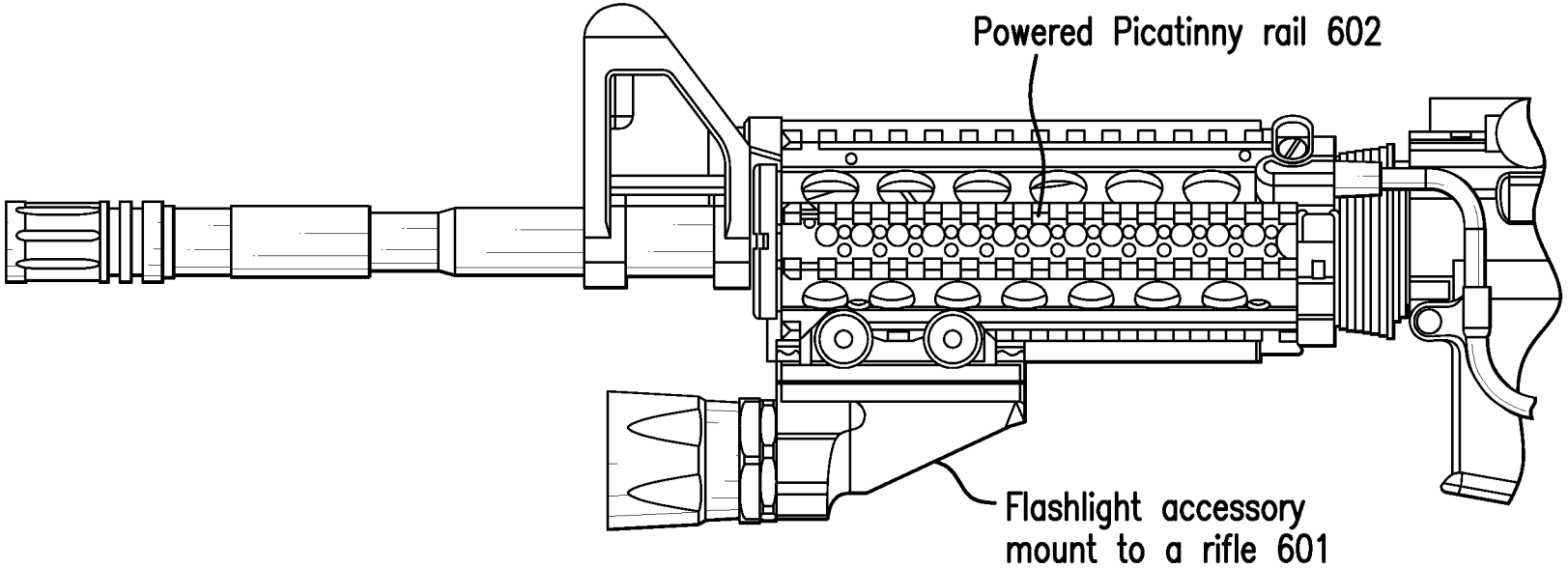
FIG. 6 shows a flashlight accessory mounted to a powered rail using the accessory mounting assembly.

FIG. 6 shows the flashlight accessory mounted to the powered Picatinny rail, using the type of rail grabber assembly demonstrated in FIG. 5.

These and other embodiments will be apparent to those of skill in the art, all within the scope of the present invention, which is defined solely by the claims appended hereto.

What is claimed is:

1. A firearm system for providing power to a power-consuming accessory attached to the firearm, the firearm system comprising:

a power source for providing a predetermined voltage;

at least one mounting rail electrically connected to the power source and having at least one power connection which presents the predetermined voltage and at least one depressible switch; and a power-consuming accessory attached to the at least one mounting rail, comprising:

a DC-DC converter, located in the power-consuming accessory, electrically connected to the at least one power connection which presents the predetermined voltage, for converting the predetermined voltage to a voltage required by the power-consuming accessory, a power-consuming accessory controller including circuitry defining power on/off states for the power-consuming accessory based on a plurality of selectors associated with the power-consuming accessory, and at least one plunger configured to depress the at least one depressible switch and at least one electrical contact configured to provide an electrical connection with the at least one power connection.

2. The firearm system of claim 1, wherein the power-consuming accessory controller is connected to the DC-DC converter for controlling the powering of the power-consuming accessory.

3. The firearm system of claim 1, further comprising:

a power switch for controlling the flow of electrical power from the DC-DC converter to the power-consuming accessory.

4. The firearm system of claim 1 wherein the power-consuming accessory controller comprises:

a plurality of switches connected to the power-consuming accessory controller for enabling a user to control operational states of the power-consuming accessory.

5. A firearm system for providing power to a power-consuming accessory attached to the firearm, the firearm system comprising:

a power source for providing a predetermined voltage;

at least one mounting rail electrically connected to the power source and having at least one power connection which presents the predetermined voltage and at least one depressible switch; and a power-consuming accessory attached to the at least one mounting rail, comprising:

a DC-DC converter, located in the power-consuming accessory, electrically connected to the at least one power connection which presents the predetermined voltage, for converting the predetermined voltage to a voltage required by the power-consuming accessory, a power-consuming accessory controller including circuitry defining power on/off states for the power-consuming accessory based on a first selector associated with the power-consuming accessory, and at least one plunger configured to depress the at least one depressible switch and at least one electrical contact configured to provide an electrical connection with the at least one power connection.

6. The system of claim 5, wherein the power-consuming accessory controller includes a plurality of control buttons, each of the plurality of control buttons having an ID.

7. The system of claim 6, wherein a first button of the plurality of control buttons corresponds to the power-consuming accessory.

8. The system of claim 7, wherein the power-consuming accessory controller is configured such that the first selector on the power-consuming accessory defines a first button of the plurality of control buttons operating the power-consuming accessory.

9. The system of claim 5, wherein the first selector is a selector switch on a battery adaptor for the power-consuming accessory.

10. A firearm system for providing power to a power-consuming accessory attached to the firearm, the firearm system comprising:

a power source for providing a predetermined voltage;

at least one mounting rail electrically connected to the power source and having at least one power connection which presents the predetermined voltage and at least one depressible switch; and a power-consuming accessory attached to the at least one mounting rail, comprising:

a DC-DC converter, located in the power-consuming accessory, electrically connected to the at least one power connection which presents the predetermined voltage, for converting the predetermined voltage to a voltage required by the power-consuming accessory, at least one plunger configured to depress the at least one depressible switch and at least one electrical contact configured to provide an electrical connection with the at least one power connection, and a power-consuming accessory controller including circuitry defining power on/off states for the power-consuming accessory based on a configuration of the power-consuming accessory, wherein the power-consuming accessory controller is configured such that a first selector and a second selector on the power-consuming accessory define a first button and a second button of a plurality of control buttons, the first and second buttons operating the power-consuming accessory, wherein the first button corresponds to momentary power for the power-consuming accessory, and wherein the second button corresponds to on/off power for the power-consuming accessory.

11. The system of claim 10, wherein the power-consuming accessory controller includes a plurality of control buttons, each of the plurality of control buttons having an ID.

12. The system of claim 11, wherein a first button of the plurality of control buttons corresponds to the power-consuming accessory.

13. The system of claim 12, wherein the power-consuming accessory controller is configured such that a selector on the power-consuming accessory defines a first button of the plurality of control buttons operating the power-consuming accessory.

14. The system of claim 10, wherein the first and second selectors are selector switches on a battery adaptor for the power-consuming accessory.

15. The system of claim 10, wherein the power- consuming accessory controller includes a plurality of configurable control buttons, the power-consuming accessory controller further including circuitry providing for at least one of the plurality of configurable control buttons to be configured according to a selector on the power-consuming accessory.

16. The system of claim 15, wherein the circuitry includes a microprocessor.

17. The system of claim 16, wherein the selector is a switch that assigns at least one of the plurality of configurable control buttons to the power-consuming accessory.

18. The system of claim 1, wherein the selector is a selector switch on a battery adaptor for the power-consuming accessory.

19. The system of claim 1, wherein the at least one depressible switch is a snap-dome switch.

20. The system of claim 1, wherein the power-consuming accessory further comprises at least one face seal configured to provide environmental protection.

* * * * *